United States Patent [19]

David et al.

[11] Patent Number: 4,696,228

[45] Date of Patent: Sep. 29, 1987

[54] SCREEN PROCESS PRINTING MACHINE

[76] Inventors: Bernard David, 20, rue Denis Papin, Bagnolet; Roger Tetard, 5, rue Bassano, Paris, both of France

[21] Appl. No.: 774,463

[22] Filed: Sep. 10, 1985

[30] Foreign Application Priority Data

Sep. 11, 1984 [FR] France ..... 84 14227

[51] Int. Cl.[4] ..... B41L 13/02; B41F 15/26

[52] U.S. Cl. ..... 101/123; 101/126; 271/267; 414/598

[58] Field of Search ..... 101/123, 124, 126, 127.1, 101/127, 114; 414/598, 728; 271/267, 273, 274

[56] References Cited

U.S. PATENT DOCUMENTS

| | | | |
|---|---|---|---|
| 1,815,021 | 7/1931 | Bland | 101/123 |
| 2,383,947 | 9/1945 | Wensel et al. | 101/123 |
| 2,610,579 | 9/1952 | Wing | 101/123 |
| 2,991,711 | 7/1961 | Ehrhard et al. | 101/123 X |
| 3,795,188 | 3/1974 | Giani | 101/126 X |
| 3,795,189 | 3/1974 | Jaffa | 101/126 X |
| 4,282,805 | 8/1981 | Lala | 101/126 X |
| 4,287,826 | 9/1981 | Brabec | 101/126 X |
| 4,305,331 | 12/1981 | Colapinto | 101/126 X |
| 4,338,860 | 7/1982 | Hamu | 101/126 |
| 4,404,903 | 9/1983 | Cronin | 101/126 X |
| 4,407,195 | 10/1983 | Jaffa | 101/126 X |
| 4,409,924 | 10/1983 | Laverty et al. | 101/126 X |
| 4,478,142 | 10/1984 | Santorineos | 101/126 X |
| 4,492,163 | 1/1985 | Ericsson | 101/126 |
| 4,520,726 | 6/1985 | Rouly et al. | 101/126 X |

FOREIGN PATENT DOCUMENTS

| | | | |
|---|---|---|---|
| 590158 | 1/1978 | U.S.S.R. | 101/123 |

*Primary Examiner*—Charles A. Pearson
*Assistant Examiner*—James R. McDaniel
*Attorney, Agent, or Firm*—Karl F. Ross; Herbert Dubno

[57] ABSTRACT

A screen printing machine comprises a support frame comprising vertical and horizontal members and having a rear side, a front side spaced horizontally forward therefrom, and a plurality of stanchions projecting upward between the front and rear sides and an auxiliary frame lying and horizontally movable on the stanchions and projecting forward past the front side of the support frame. A screen is clamped to the auxiliary frame so that the screen is cantilevered on and projects forward beyond the front side of the support frame and lies fully forward of the front side of the support frame. A platen disposed below the screen and forward of the front side of the support frame is pivotal on this support frame at its rear side about a pivot axis so that the platen projects wholly beyond the front side of the support frame and access to the platen and the screen is afforded on all sides thereof except for rear edges of the screen and the platen which are proximal to the support frame. A carriage displaceable along the auxiliary frame generally parallel to the axis defined by the pivot carries a scraping and lapping device overlying the screen and cantilevered from the carriage so as to be disposed wholly forward of the front side of the support frame above the screen and plate.

5 Claims, 8 Drawing Figures

SCREEN PROCESS PRINTING MACHINE

FIELD OF THE INVENTION

The present invention concerns a screen-process printing machine comprising a film screen that is fixed on a support frame of the machine at least during printing, a platen that forms a support for the material to be printed and that pivots on the support frame so as to open downward, and a scraping and lapping device.

OBJECTS OF THE INVENTION

The object of the invention is to improve on this type of machine, particularly by making it easier to use.

SUMMARY OF THE INVENTION

The machine according to this invention has its film screen and printing platen mounted such that they project from the support frame and are pivotal about an axis at the rear of the support frame.

By virtue of this layout, three sides of the machine are completely open to ease assembly of its parts—in particular, the screen, scraper, and lapper—and to ease access to the top of the platen since it is fairly far from its pivot axis and since it is inclined somewhat downward when it is pivoted down. The correct positioning of the outer edges of a sheet to be printed is easy since there is nothing in the way, and in fact such loading of the press can be carried out by a seated operator.

The scraping and lapping device is advantageously mounted to project from the carriage that can move transversely, that is parallel to the hinge axes of the platen. The film screen and the carriage that carries the scraping and lapping device are carried on an auxiliary support frame in turn resting on small columns or stanchions of the support frame and are kept in position on these stanchions by one or more springs.

The printing platen is a honeycomb closed on its front and side edges and lower face but open on its upper face and is formed with crosswise passages that communicate with a rear manifold connected to a suction line. This makes it possible to eliminate the conventional blower box underneath the platen, thereby reducing its weight and cost and making it easier to move rapidly.

The film screen can be taken off the platen fairly easily since it is only held in place by screws from arms extending along two of its sides.

As is known, the machine can be equipped with retractile edge stops. Preferably at least one edge stop is slidable inside a guide fixed to the platen and having on its face turned toward the inside of the platen a longitudinal slot spacedly receiving a longitudinal blade that is bent such that its upper end projects from the stop. This blade can operate a microswitch carried on the stop. This microswitch which can be set to react to a movement of as little as 0.1 mm is connected in the start circuit of the machine.

A printing cycle cannot be started unless the outer edges of the sheet are properly positioned.

The scraping and lapping device can include a scraper support and a lapper support pivoted on an arm pivoted in turn on the carriage. A first actuator is mounted between the arm and the carriage and a second actuator between the scraper and lapper supports to raise one and lower the other and vice versa.

The second actuator lowers the scraper for scraping or lowers the lapper for lapping. The first actuator presses the lapper or scraper against the printing screen.

The scraper and lapper are each carried on a link which can be oscillated on the respective support relative to an axis perpendicular to the arm. The scrapper and lapper are preferably hinged at their links to their support. It is therefore possible to change the scraper or lapper in a few seconds without the use of tools.

DESCRIPTION OF THE DRAWING

The above and other features and advantages will become more readily apparent from the following, reference being made to the accompanying drawing in which.

SPECIFIC DESCRIPTION

Figure 1:
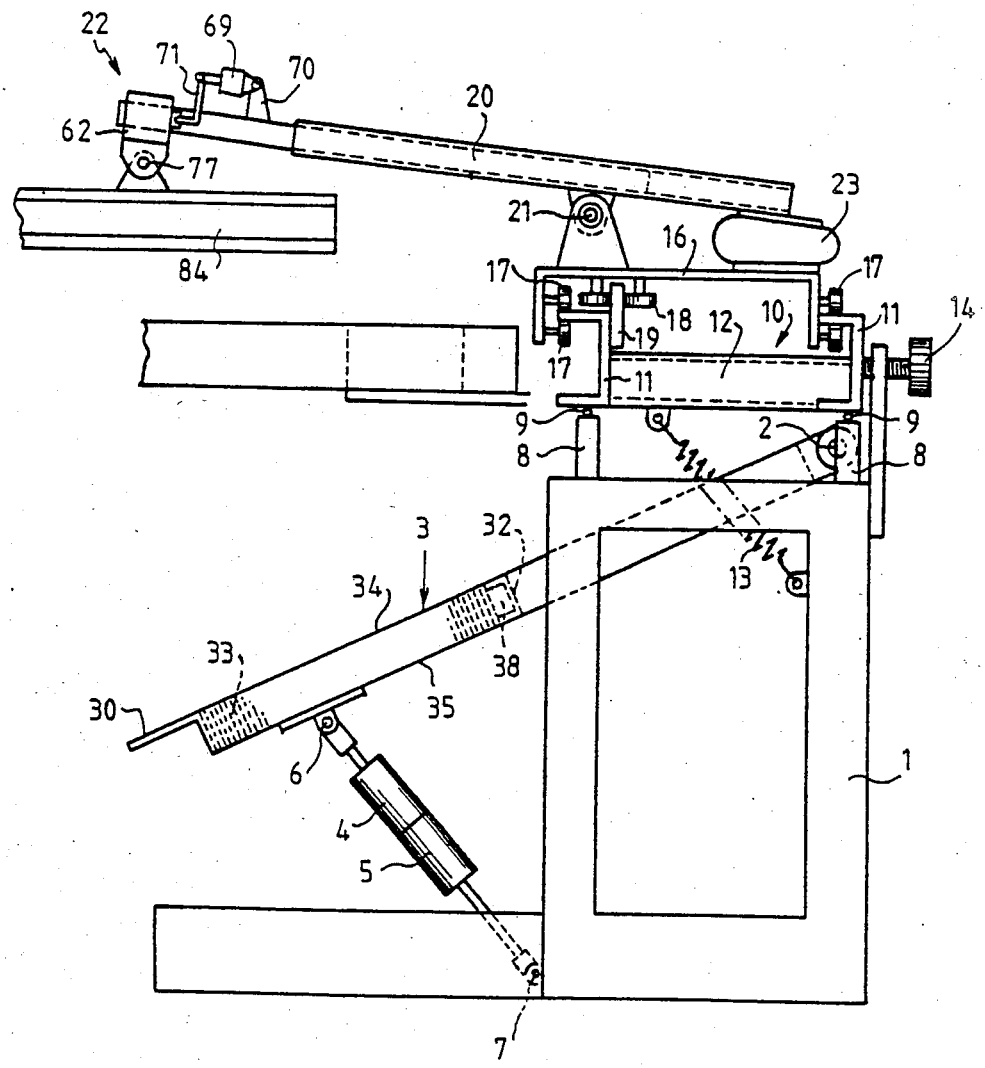
FIG. 1 is a side view of the machine.
Figure 2:
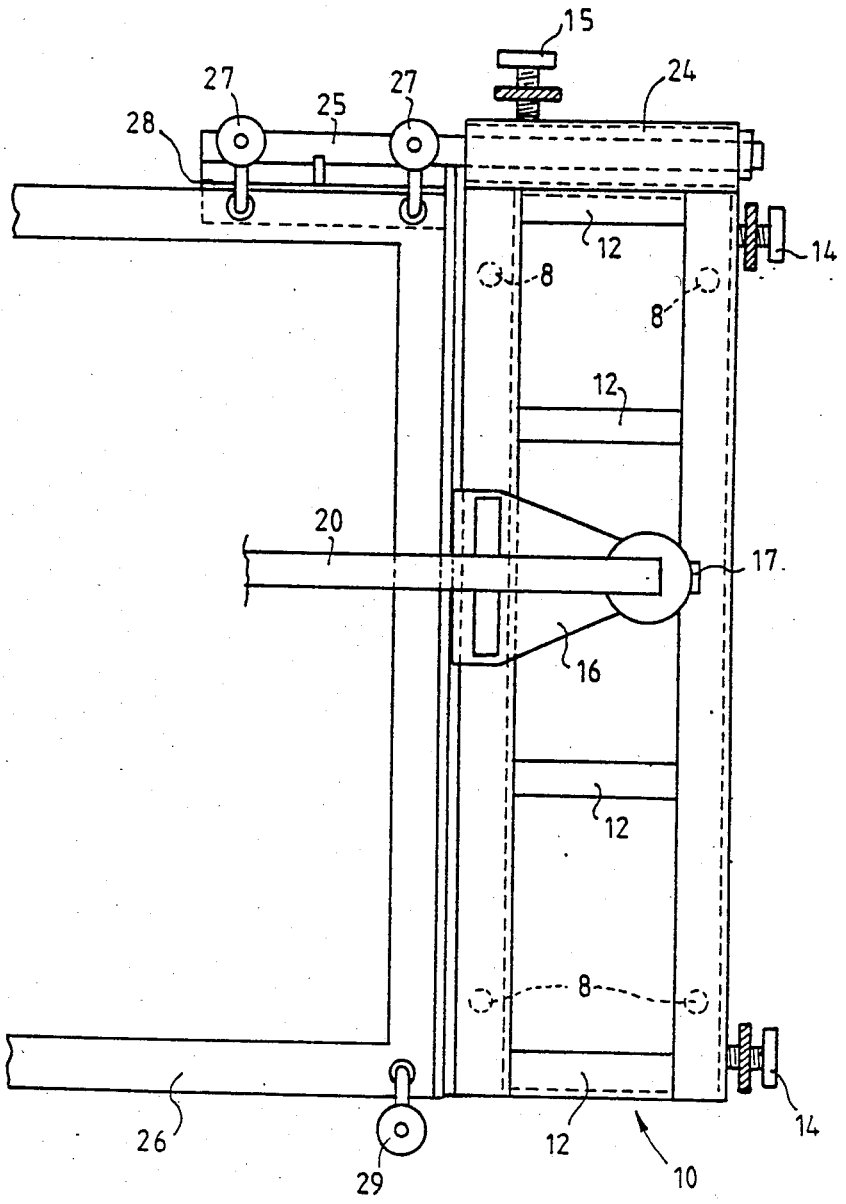
FIG. 2 is a top view of the machine, the scraping and lapping device having been left out for clarity of view.

As seen in FIGS. 1 and 2, the screen-process printer according to the invention has a support frame 1 having at its rear side a spindle 2 which serves as a pivot for a platen 3. Two actuators 4 and 5 are fixed to each other and have piston rods 6 connected to the platen 3 and rear ends connected at 7 to the support frame 1.

Four vertical and height-adjustable stanchions 8 project up from the support frame 1 and have at their upper ends conveyor balls 9. An auxiliary frame 10 formed of two U-section slide rails 11 joined to each other by crosspieces 12 rides on these balls 9. One or more springs 13 stretched between the crosspieces 12 and the support frame 1 hold same down on the balls 9 and press it back against two adjustable stops 14 provided at the rear of the support frame 1 to limit the rearward longitudinal movement of the support frame 10. Another adjustable stop 15 (FIG. 2) is provided on one of the sides of the support frame 1 to set the transverse position of the support frame 10.

A carriage 16 is supported on the slide rails 11 by means of rollers 17 having horizontal axes and riding on the upper and lower faces of the upper flanges of these slide rails 11. This carriage 16 is guided transversely by rollers 18 rotatable about vertical axes and engaging on both upright faces of a plate 19 fixed to one of the slide rails 11. A control fluid-powered actuator (not illustrated) connects this carriage to the support frame 10.

A telescopic scraping and lapping arm 20 can pivot at 10 at an intermediate point along its length on the carriage 16 and carries a scraping and lapping device generally indicated at 22. A pair of rubber bladders 23 or a diaphragm-type vessel is engaged between the rear end of the arm 20 and the carriage 16. The scraping and lapping pressures can therefore be adjusted by controlling the pressure in the bladders 23 by means of a pressure-reducing valve and a manometer (not illustrated).

As seen in FIG. 2 a rod 25 is pivotally mounted in a tube 24 fixed on one of the sides of the support frame 10. A film screen 26 bearing a not illustrated printed calico design is fixed by clamps 27 at the side of the screen 26 at angle irons 28 integral with the rod 25 and so mounted on this rod 25 lies in the same plane as the cloth 26. The opposite side of the support frame 10 carries clamps 29 which hold the film screen 26 in position. This screen 26 is thus easily removed yet is solidly fixed during printing.

Thus the printing platen 3 and the film screen 26 project or are cantilevered from the front of the machine, as does the scraping and lapping device 22. This leaves full access to the front and two sides of the film screen 26 so that a sheet can be positioned accurately and removed with no hindrance. In addition the projection of the scraping and lapping device 22 eliminates the prior-art slide rail in front of the feed or above the film screen 26.

Figure 3:
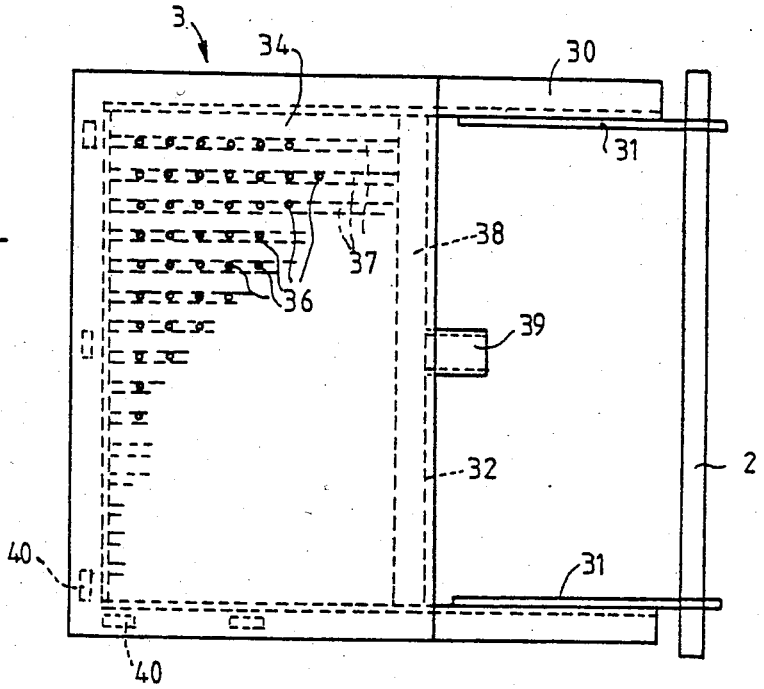
FIG. 3 is a top view of the printing platen.

FIG. 3 shows how the printing platen 3 is formed of an angle iron 30 along both its sides and its front and extending rearward as two arms 31 fixed on the pivot spindle 2. A U-section channel 32 of the same height as the angle iron 30 forms the rear edge of the platen 3.

The space bounded by the angle iron 30 and channel 32 is filled with a honeycomb structure 33 whose upper and lower faces are formed by respective steel plates 34 and 35, the upper plate 35 being formed with an array of perforations 36. This structure 33 is formed with front-to-back transverse passages 36 that open into a chamber 38 of the channel 32. This chamber 38 acts as a suction manifold and is connected to a suction line 39.

Margin stops are provided on one of the sides of the printing platen 3 and on either its front or rear edge also. The locations of these stops are shown generally at 40 in FIG. 3.

Figure 5:
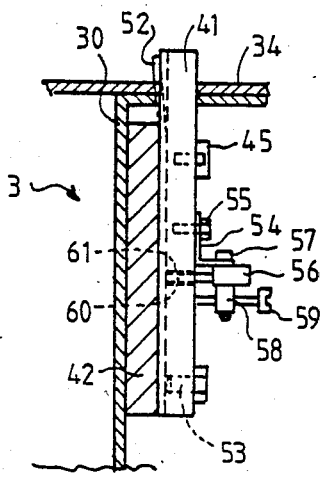
FIG. 5 is a side view of the stop.
Figure 6:
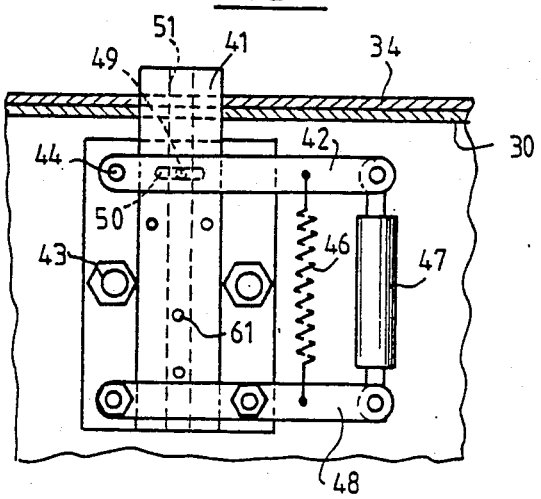
FIG. 6 is a front view of the stop.
Figure 4:
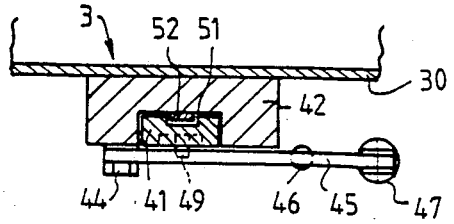
FIG. 4 is a top view of an edge stop.

As shown in detail in FIGS. 4, 5, and 6, an edge stop 41 can slide inside a guide 42 fixed by bolts 43 on the vertical flange of the peripheral angle-iron 30. A lever 45 is pivoted at 45 on the guide 42 which is pulled downward by a return spring 46 and an actuator to a lever 48 fixed to the guide 42. This lever 45 carries a finger 49 engaged in a slot 50 formed in the stop 41 such that the actuator 47 can move the stop 41 up and down in the guide 42.

The sheet to be printed is placed on the platen 3 and positioned against the stops 40. The platen 3 is then raised toward the underside of the screen 26 and the lapper and wiper 22 are used to print through this screen 26 onto the sheet.

The stop 41 has on its face turned toward the slide rail 42 a longitudinal groove 52 in which a slightly bent blade 52 is recieved with some play and with its upper end projecting laterally from the stop 41 as shown in FIG. 5. This blade 52 is held on the stop 41 at its lower end by a screw 53 which allows it to move somewhat.

An angle iron 54 that is thin enough to bend is fixed by screws 55 onto the face of the stop 41. This angle iron 54 carries a microswitch 56. Screws 57 fix this microswitch 56 to the angle iron 54 along with a small block 58 made of semirigid material, e.g. a polyamide resin. This block 58 is formed with a tapered threaded hole in which is threaded a screw 59 perpendicular to the stop 41. A pin 60 passing through a hole 61 in the stop 42 engages between the blade 52 and the actuating button of the microswitch 56.

The position of the microswitch 56 is adjusted by means of the screw 59 so that it closes 0.1 mm to 0.2 mm before the blade 52 is pushed completely back into its groove 51. The microswitch 56 is in the start circuit of the machine. Thus this start cycle can only commence if the sheet to be printed is within 0.1 mm or at most 0.2 mm of the stop 41.

Figure 7:
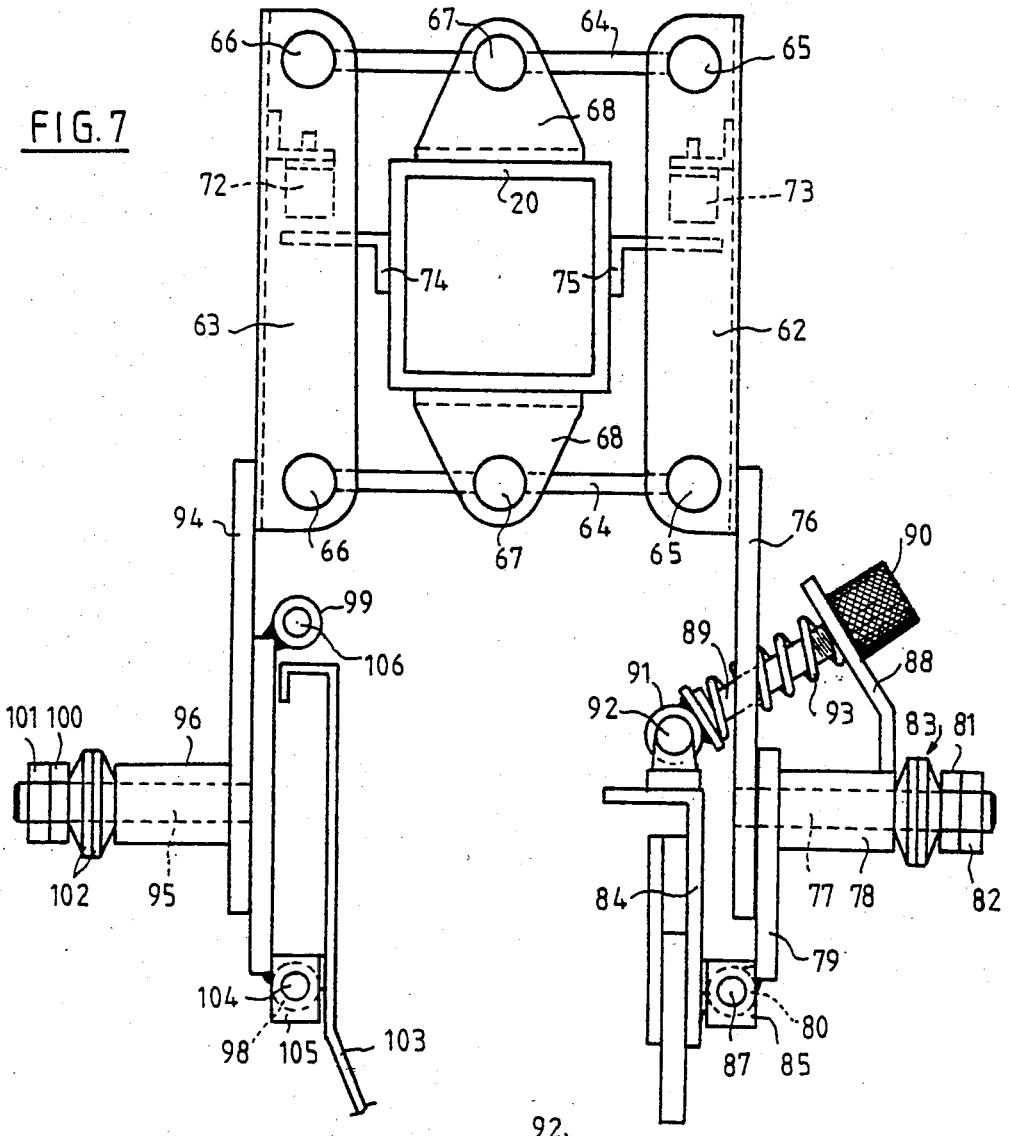
FIG. 7 is an end view of the scraping and lapping device.

As seen in FIG. 7 the scraping and lapping device 22 includes a scraper support 62 and a lapper support 63 interconnected to each other by two rocker bars 64 of the same length and pivoted at their ends at 65 and 66 on the respective supports 62 and 63. Each rocker bar 62 or 63 is also pivoted at its center on a spindle 67 carried by an ear 68 integral with the arm 20. A fluid-powered actuator 69 (FIG. 1) is pivoted on a tab 70 integral with the arm 20 and has a piston rod connected by a bent lever 71 to the scraper support 62. This actuator 69 thus allows this support 62 to be moved into its lower working position or its upper out-of-service position, which latter position brings the lapper support 63 into its lower working position. The lower position of each of the two supports 62 and 63 is established by rubber stops 72 and 73 integral with these supports 62 and 63 and engageable with angle-irons 74 and 75 fixed on the arm 20.

The scraper support 62 is extended downward by a plate 76 parallel to the arm 20 and having a rear face to which is welded a perpendicular spindle 77. A tube 78 can oscillate on the spindle 77. This tube 78 is integral with a plate 79 whose lower part is connected to a tube 80 forming a bearing for a rod 87 roughly parallel to the arm 20.

The end of the spindle 77 is threaded and receives a nut 81 and a lock nut 82 which retain this tube 78 on the spindle 77 and which compress a stack of Belleville washers 83 to brake oscillation of the tube 78.

A scraper 84 is rotatable about the axis of the tube 80. To this end two angle irons 85 are fixed on the lower part of the scraper 84 at its rear face, the clearance between these elements 85 being equal to the length of the tube. These elements 85 are formed with holes 86 and the rod 87 that is journaled in the tube 80 is seated at its ends in these holes 86.

In addition this tube 78 is integral with a plate 88 that is bent in and upward. A rod 89 has a threaded end passing loosely through a hole in the plate 88 and carrying a knurled adjustment nut 90. The other end of the rod 89 is integral with a tube 91 roughly parallel to the tube 80 and journaling a rod 92 fixed to the upper face of the scraper 84 and extending parallel to same. A helical spring 93 engages around the rod 89 and bears between the tube 91 and the plate 88. The nut 90 thus establishes the orientation of the scraper 84.

The lapper support 63 is extended downward by a plate 94 whose outer face is welded to a tube 96. This tube 96 pivotally supports a shaft 95 integral with a plate 97 onto which are connected two bearing-forming tubes 98 and 99. The ends of the shaft 95 is threaded and carries a nut 100, a lock nut 101, and a stack of Belleville washers.

Figure 8:
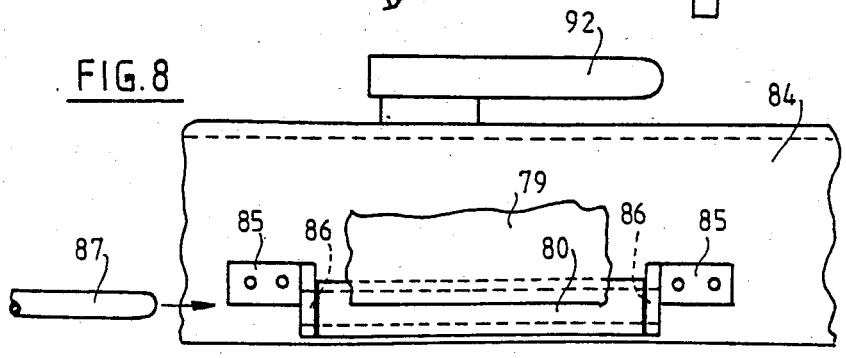
FIG. 8 is a front view of a part of the scraper.

As also seen in FIG. 8 a lapper blade 103 is fixed to the plate 97 by structure like that supporting the scraper blade 84. A rod 104 passes through both the tube 98 and two tube 105 fixed on the blade 103. This blade 103 also carries a pin 106 engaged in the tube 99.

What is claimed is:

1. A screen printing machine comprising:

a support frame comprising vertical and horizontal members and having a rear side, a front side spaced horizontally forward therefrom, and a plurality of stanchions projecting upward between the front and rear sides;

an auxiliary frame lying and horizontally movable on the stanchions and projecting forward past the front side of the support frame;

an abutment fixed on the support frame behind the auxiliary frame;

a spring engaged between the auxiliary frame and the support frame and pulling the auxiliary frame down against the stanchions and back against the abutment;

means for affixing a screen to the auxiliary frame so that said screen is cantilevered on and projects forward beyond the front side of the support frame so that said screen lies fully forward of the front side of the support frame;

a platen disposed below said screen and forward of the front side of the support frame;

means including a horizontal pivot disposed at the rear side of the support frame for pivoting the platen on the support frame about a pivot axis so that said platen projects wholly beyond said front side of said support frame and access to said platen and said screen is afforded on all sides thereof except for rear edges of said screen and said platen which are proximal to said support frame;

a carriage displaceable along said auxiliary frame generally parallel to the axis defined by said pivot; and a scraping and lapping device overlying said screen and cantilevered from said carriage so as to be disposed wholly forward of said front side of said support frame above the screen and plate.

2. The machine defined in claim 1 wherein said platen is provided with a pair of rearwardly extending arms beneath said carriage and swingably connected to said support frame at said pivot axis.

3. The machine defined in claim 1, wherein said platen has a edge stop shiftable in a sliding rail, formed with a face turned toward the platen and formed with a longitudinal groove, the machine further comprising a longitudinal blade received in said groove and having an upper extremity projecting horizontally from the stop and a microswitch operable by said stop on engagement of the blade with a sheet to be printed and lying on the platen.

4. The machine defined in claim 1 wherein said scraping and lapping device includes a scraper support and a lapping support;

an arm articulated on said carriage pivotally supporting the scraper and lapping supports, and means including respective actuators operatively engaged between the scraper and lapping supports and the arm on the carriage for alternately raising and lowering said scraper support and said lapping support.

5. The machine defined in claim 4, further comprising a bellows between the arm articulated to the carriage and the carriage for pivoting the arm on the carriage relative thereto and thereby controlling the position of said arm articulated to said carriage.

* * * * *